US008342986B2

(12) United States Patent
Rourke

(10) Patent No.: US 8,342,986 B2
(45) Date of Patent: Jan. 1, 2013

(54) MULTI-PURPOSE SPRING-LOADED DIVOT REPAIR TOOL

(75) Inventor: James Rourke, Worcester, MA (US)

(73) Assignee: James Rourke, Worcester, MA (US)

( * ) Notice: Subject to any disclaimer, the term of this patent is extended or adjusted under 35 U.S.C. 154(b) by 150 days.

(21) Appl. No.: 12/924,067

(22) Filed: Sep. 21, 2010

(65) Prior Publication Data

US 2011/0081994 A1 Apr. 7, 2011

Related U.S. Application Data

(63) Continuation-in-part of application No. 12/220,652, filed on Jul. 28, 2008, now abandoned.

(51) Int. Cl.
*A63B 57/00* (2006.01)

(52) U.S. Cl. ..... 473/408

(58) Field of Classification Search ..... 473/406, 473/408, 286; D21/793, 795
See application file for complete search history.

(56) References Cited

U.S. PATENT DOCUMENTS 845,792 A * 3/1907 Jenkins ..... 30/162
3,360,807 A * 1/1968 Mauck ..... 7/158
3,539,017 A * 11/1970 Johnson ..... 172/378
5,388,824 A * 2/1995 Reimers ..... 473/406
5,449,169 A * 9/1995 Hardin et al. ..... 473/408
5,788,197 A * 8/1998 Tutela ..... 248/156
6,413,173 B1 * 7/2002 Muller et al. ..... 473/408
6,413,174 B1 * 7/2002 Roberts ..... 473/408
6,428,430 B1 * 8/2002 Chong ..... 473/408
6,620,062 B2 * 9/2003 Taylor et al. ..... 473/408
6,837,807 B1 * 1/2005 Kerr ..... 473/408
7,238,125 B2 * 7/2007 Dymling ..... 473/408
7,305,769 B2 * 12/2007 McHenry et al. ..... 30/162
7,686,710 B2 * 3/2010 Leiber et al. ..... 473/408
2003/0109336 A1 * 6/2003 Taylor et al. ..... 473/408
2006/0247075 A1 * 11/2006 Dymling ..... 473/408
2009/0098952 A1 * 4/2009 Leiber et al. ..... 473/408

* cited by examiner

*Primary Examiner* — Steven Wong
(74) *Attorney, Agent, or Firm* — Mark Joubert, Esq.

(57) ABSTRACT

A multi-purpose spring-loaded divot repair tool comprising, in one embodiment, a forked end containing two prongs, a round ball marker, a concave recession, a handle, and a belt clip. The two prongs extend from one end of the handle and are used to repair divots. The round ball marker is located on the handle and is distally positioned to the forked end. Furthermore, the concave recession is proximally located to the round ball marker and distally located to the forked end, such that the concave recession faces upward when the forked end is inserted into the ground. The tool is manufactured from high quality materials. In a further embodiment, a dual acting spring loaded actuation system including spring action in both the deployment and return directions for actuating the forked end.

15 Claims, 5 Drawing Sheets

MULTI-PURPOSE SPRING-LOADED DIVOT REPAIR TOOL

CROSS REFERENCE TO RELATED APPLICATION

This application is a continuation-in-part of prior U.S. application Ser. No. 12/220,652 filed on Jul. 28, 2008, now abandoned the contents of which are incorporated herein by reference.

FIELD OF THE INVENTION

The present invention relates generally to a double action Out-The-Front ("OTF") or retractable golfer's tool that allows the user to extend or retract the divot tool with the press of a sliding button.

REFERENCES

In general within the art, descriptions of golfers' tools are found in U.S. Pat. No. 5,405,133 set forth by Upton; and U.S. Pat. No. 5,759,120 set forth by Mathis et al.; and U.S. Pat. No. 5,788,197 set forth by Tutela; and U.S. Pat. No. 5,816,262 set forth by Javnozon; and U.S. Pat. No. 5,819,750 set forth by Moyer; and U.S. Pat. No. 6,162,137 set forth by Jones et al.; and U.S. Pat. No. 6,428,430 B1 set forth by Chong; and U.S. Pat. No. 6,572,495 B1 set forth by Ferrari; and U.S. Pat. No. 6,620,062 B2 set forth by Taylor et al.; and U.S. Pat. No. 6,837,807 B1 set forth by Kerr; and Pat. No. Des. 247,686 set forth by Desjardins; and Pat. No. Des. 300,160 set forth by Johnson; and Pat. No. Des. 409,705 set forth by Fazekas; and Pat. No. D465,539 S set forth by Tate.

BACKGROUND OF INVENTION

A switchblade is a type of knife with a folding or sliding blade that springs out of the grip when a button or lever on the grip is pressed. Double action OTFs allow the user to extend or retract the blade with the press of a sliding button. This invention replaces the blade of an OTF automatic stiletto switch knife with a golf divot tool blade and adds a cigar holder to the other end and a magnetic ball marker on the handle. Previous attempts at divot repair tools focused on providing golfers the ability to perform many functions associated with golfing in one handy tool. However, the prior art in the field lacks a repair tool that is not only functional and useful, but eye-catching, aesthetically pleasing, and unique as well.

Golfers depend upon a variety of secondary tools, such as ball washers, cleat cleaners, and probably most commonly, a turf repair tool. Turf repair tools commonly include two extending prongs which are used to repair a ball mark depression in a golf course resulting from the impact of a golf ball landing on the green thereby relieving the green of a surface irregularity that may adversely affect the putting conditions. Such tools may be formed as pocket-sized devices with hidden or otherwise protected prongs. For example, Upton U.S. Pat. No. 5,405,133 discloses a device where a folding ball mark repair tool is formed with a switchblade type mechanism.

Typically, prior art turf repair tools enable a golfer to safely support a cigar while playing a golf ball. Often, in an effort to reduce clutter in the golfer's bag, turf repair tools are combined with other tools. For example, U.S. Pat. No. 4,007,928 discloses a turf repair tool that functions as a shoe horn and receives a ball marker. U.S. Pat. No. 4,535,987 discloses a turf repair tool with an integral score keeper, a spike tightener and a bottle opener. U.S. Pat. No. 4,960,239 discloses a turf repair tool with a ball marker and with clips for receiving golf tees. In addition, U.S. Pat. No. 5,292,120 discloses a tool with a pair of turf repair tines, a concave edge for supporting the grip of a golf club and features for cleaning and tightening cleats on a golf shoe.

U.S. Pat. No. 5,305,999 discloses a golf tool with many of the features already referred to. In addition, the edge of the tool opposite the tines includes a circular notch dimensioned to releasably hold a cigarette. Thus, the tines of the tool can be urged into the turf and a cigarette can be frictionally clipped in the upwardly facing recess to hold the cigarette while the golfer is playing a ball.

A golf outing is an ideal time to smoke a cigar for several reasons. For example, it may take at least one half hour to smoke a cigar. A round of golf is one of the few times when a cigar smoker has the opportunity to smoke an entire cigar. Smoking a cigar while playing a ball is typically impractical. Usually, the golfer will simply place the lit cigar on the turf while hitting the ball. The golfer will then pick up the cigar from the turf and continue smoking until it is his turn to hit the ball again.

The concern with picking up and smoking a cigar previously laid on the turf is due to the pesticides, herbicides, and a broad range of chemical fertilizers that are used regularly on golf courses. A cigar smoker who places the moist end of a cigar on the turf is likely to be ingesting these chemicals when he places the cigar back in his mouth.

In view of the above, prior art developed to provide golfers an accessory for safely supporting a cigar in a spaced relationship to the chemically treated turf of a golf course. Furthermore, prior art developed incorporating the use of a divot repair tool with a cigar or cigarette holder.

U.S. Pat. No. 5,405,133 to Upton discloses a folding ball mark repair tool with an elongated flattened handle that has a longitudinal central slot formed therein wherein the blade shank is pivotally disposed. A limitation of the prior art as seen in Upton and U.S. Pat. No. 6,162,137 to Jones et al. is that the blade shanks are commonly deployed via a longitudinal slot on the side of the handle. An alternate design is that the blade shanks are slidably positioned within the handle as seen in U.S. Pat. No. 6,428,430 to Chong. However, these prior art inventions fail to include a divot repair tool made from materials of the highest quality wherein the blade shanks are deployed via a double action OTF mechanism.

What is needed is a light weight, portable, divot repair tool made of high quality materials comprising a hidden spring within the handle that deploys via a double action OTF mechanism. Such a design allows the tool to be efficiently and conveniently carried in a pocket or golf bag without the concern of the forked end being exposed. The present invention provides a solution to all these shortcomings.

SUMMARY OF THE INVENTION

The instant invention, as illustrated herein, is clearly not anticipated, rendered obvious, or even present in any of the prior art mechanisms, either alone or in any combination thereof. A multi-purpose spring-loaded divot repair tool designed to overcome the previously mentioned shortcomings of earlier problems in the art would provide golfers the ability to perform many functions associated with golfing in one handy tool, which is not only functional and useful, but eye-catching, aesthetically pleasing, and unique as well. Thus, the several embodiments of the instant invention are illustrated herein.

Therefore, it is an object of the present invention to overcome the previously mentioned shortcomings found in the prior art with a divot repair tool and cigar holder.

Another object of the present invention is to provide an improved divot repair tool and cigar holder that supports a cigar above ground.

Another object of the present invention is to provide an improved divot repair tool and cigar holder which effectively repairs divots.

Another object of the present invention is to provide an improved divot repair tool and cigar holder which includes a magnetic ball marker on the handle.

Another object of the present invention is to provide an improved divot repair tool and cigar holder which attaches to a removable belt clip.

Another object of the present invention is to provide an improved divot repair tool that is manufactured from the highest quality materials.

These together with other objects of the invention, along with various features of novelty which characterize the invention, are pointed out with particularity in the claims, Detailed Description of the Embodiments Sections and drawings of this application, with all said sections adding to this disclosure.

DETAILED DESCRIPTION OF THE DISCLOSED EMBODIMENTS

Figure 3:
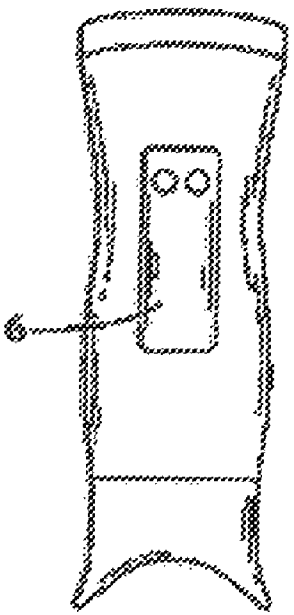
FIG. 3 illustrates a rear view of the multi-purpose spring-loaded divot repair tool, further illustrated the removable belt clip in which the divot repair tool is to be worn.
Figure 2:
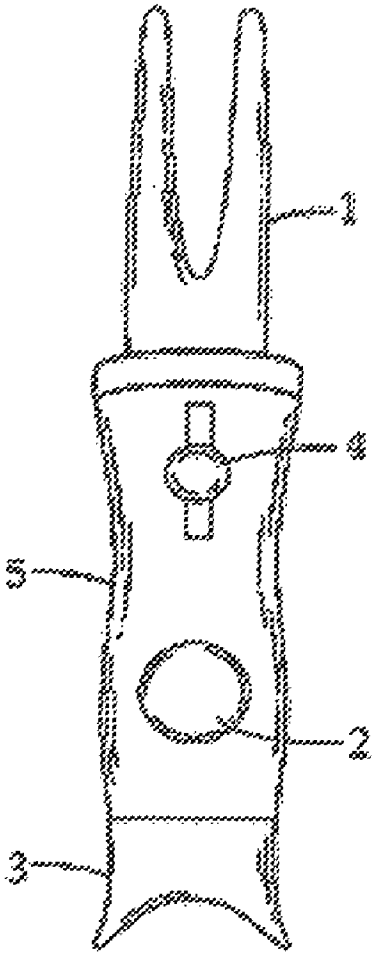
FIG. 2 illustrates a front view of the multi-purpose spring-loaded divot repair tool and various features of this embodiment of the divot repair tool when viewed with the forked end pointing upward.
Figure 1:
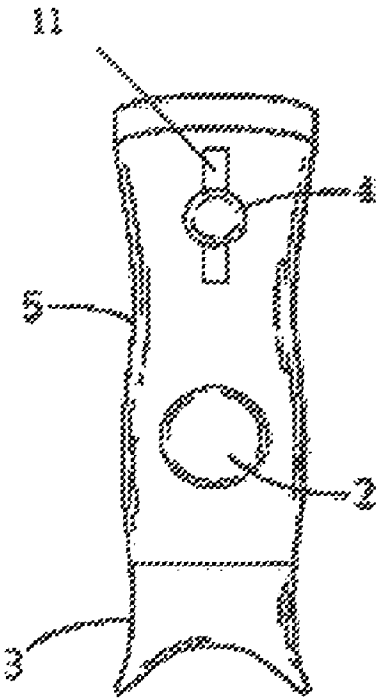
FIG. 1 illustrates a front view of the multi-purpose spring-loaded divot repair tool and various features of this embodiment of said divot repair tool when viewed with the recession pointing downward.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention, such as multi-purpose spring-loaded divot repair tools that have various sizes, dimensions, and are comprised of various materials.

The present invention solves all the shortcomings found in the prior art by introducing a multi-purpose spring-loaded divot repair tool that comprises a forked end; a round ball marker; a concave recession; a handle; and a belt clip. The divot repair tool further comprises a spring loaded within the handle.

FIGS. 1-4 commonly illustrate the differing views of the different embodiments of the instant invention. The multi-purpose spring loaded divot repair tool is illustrated as comprising a forked end 1, a round ball marker 2, a concave recession 3, a switch or actuation button 4, a handle 5, a removable belt clip 6, and a spring 7.

The switch or actuation button 4 is located at the upper end of the handle 5 when the forked end 1 is pointed upward. The switch button 4 functions in such a way that when it is pushed upward, the forked end 1 deploys via a tensioning spring mechanism 7 that is loaded with the handle 5, much like a switch blade as known within that industry.

The round ball marker 2 is located towards the bottom end of the handle 5 when the forked end is pointing upward. The removable belt clip 6 attaches to the side of the handle 5 opposite from where the switch button 4 is located. Also illustrated is the slot 11 wherein the switch button 4 moves to release the tensioning spring 7 and which works in concert with attached the retraction handle 9, to extend and retract the forked end 1. These elements are further illustrated in FIG. 4.

The forked end 1 functions in such a way that it is inserted into the ground, allowing the golfer to rest a cigar in the concave recession 3 that is pointing away from the ground. The removable belt clip 6 functions in such a way that it can be attached to the side of the handle 5 opposite from where the switch button is located and removed from said side of the handle 5. The round ball marker 2 functions to mark ball position on a golf course.

FIG. 3 illustrates a rear view of the handle 5. The removable belt clip 6 is attached to the handle 5. Also illustrated is the actuation button 4 which releases the tensioning spring 7, which works in concert with attached retraction handle 9, which is illustrated in FIG. 4.

Figure 4:
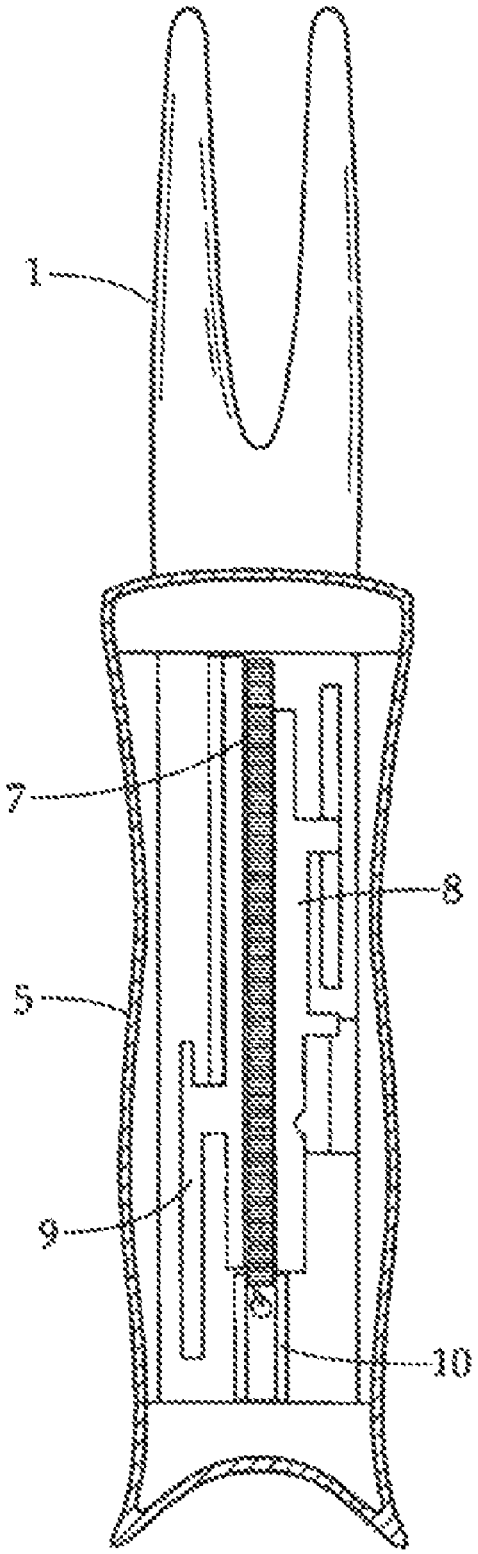
FIG. 4 illustrates a cross sectional front view of the spring actuation system of the divot repair tool.

FIG. 4 illustrates a cross sectional front view of spring actuation system of said divot repair tool. As illustrated, a tensioning spring 7 and a slide assembly 8 is utilized, and these are used in concert with a retraction handle 9 in order to recoil the tension spring 7 and reset the mechanism upon actuation of the tension spring 7 via the actuation button 4. The spring assembly 7 is anchored on the stopper assembly 10.

Figure 5:
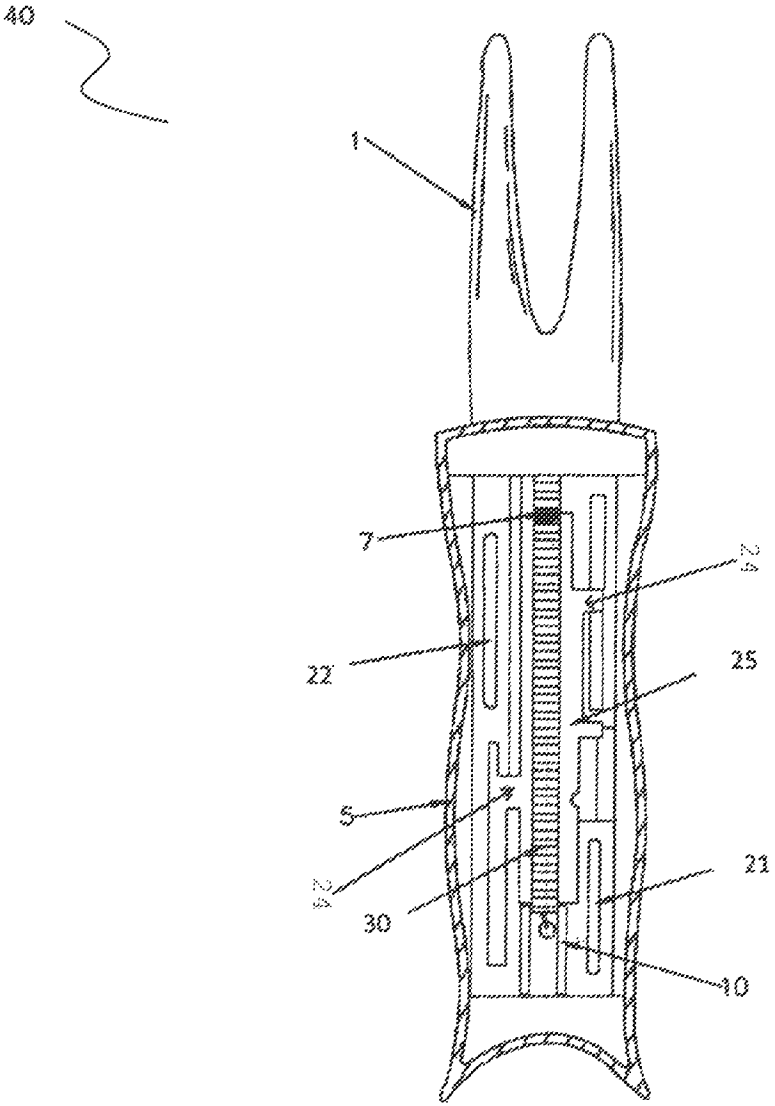
FIG. 5 illustrates a cross sectional front view of the dual direction, two opposing lever spring actuation embodiment of the divot repair tool.
Figure 6:
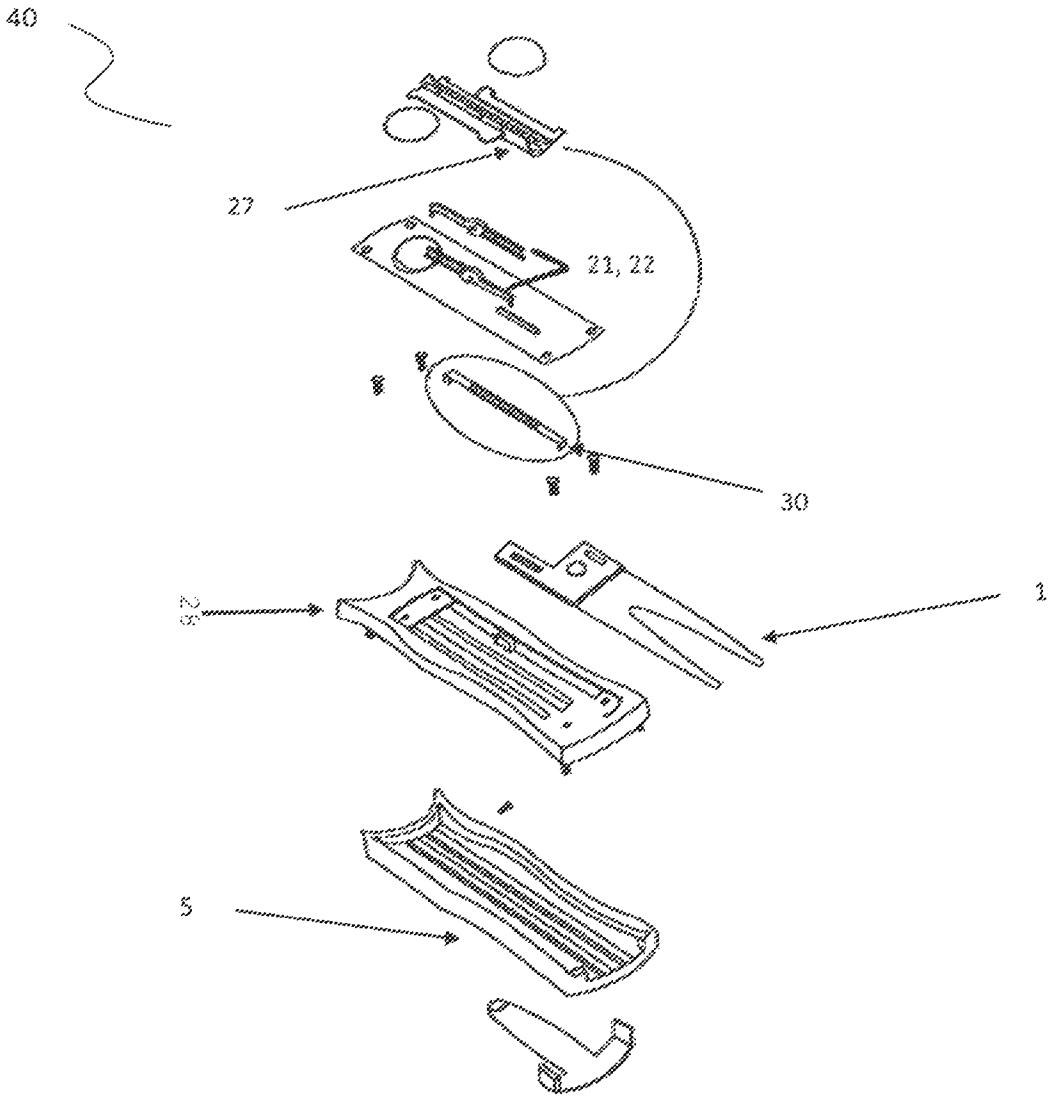
FIG. 6 illustrates an assembly view of the dual direction, two opposing lever spring actuation embodiment system of the divot repair tool.
Figure 7:
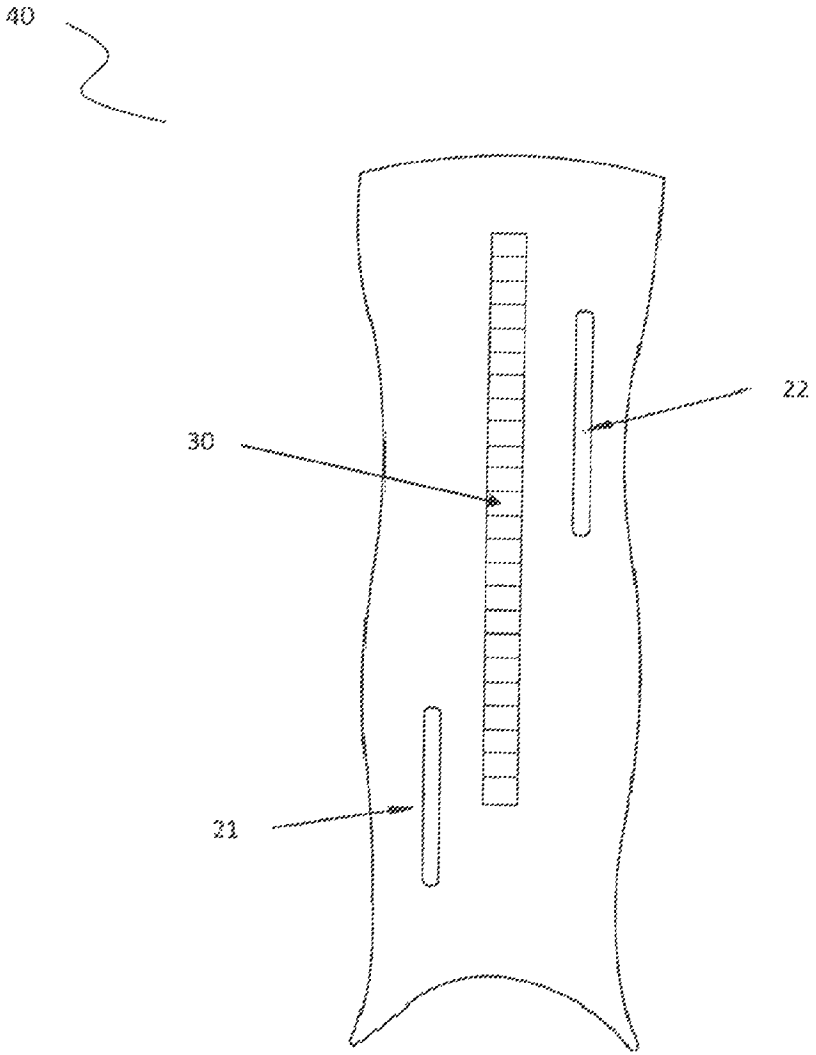
FIG. 7 illustrates a front view of the dual direction, two opposing lever spring actuation embodiment of the divot repair tool.

In an additional embodiment, illustrated in FIGS. 5 through 7, unlike concurrent systems, the instant system features a dual acting spring loaded system 40 which comprises spring action in both the deployment and return directions. An additional feature, made possible by the dual acting spring loaded system 20 comprising a main spring 30 and two opposingly disposed spring-loaded levers, discloses the novel operational capability wherein the apparatus operates in both the deployment and return directions with just a touch of the respective actuation members or levers, the deployment spring-loaded lever 21 and the retraction spring-loaded lever 22 by the user. The deployment spring-loaded lever 21 and the retraction spring-loaded lever 22 are pivotally mounted in central housing member 28 and linked with internal actuation mechanisms 24 shown in FIG. 5, which are in communication with the main spring. The internal actuation mechanisms 24 are formed as protrusions from the opposing edges of the single slide cartridge 25, and are in communication with the opposingly disposed spring-loaded levers 21, 22.

Thus, unlike concurrent designs which force the user to advance the lever up or down the shaft manually for deployment and return of the forked end 1, the instant design allows the forked end 1 to spring out for usage and spring back in for storage, and lock into place at either final destination, all with just a light touch by the user. The main spring 30 should reside in a channel 27 which is placed into the slide cartridge 25.

What is claimed is:

1. A hand held personal tool for use to reseat and repair sod comprising:

a forked end;

a dual acting spring loaded actuation system including spring action in both the deployment and return directions for actuating the forked end comprising:

a main spring;

a first and second opposingly disposed spring-loaded levers in communication with the main spring;

a single slide cartridge disposed to house the main spring;

a channel disposed to retain the single slide cartridge;

a first and second internal actuation mechanism, the first internal actuation mechanism formed as a protrusion from an edge of the single slide cartridge and in communication with the first opposingly disposed spring-loaded lever, the second internal actuation mechanism formed as a protrusion from an opposing edge of the single slide cartridge and in communication with the second opposingly disposed spring-loaded lever;

a removably attachable round ball marker;

a concave recession;

a handle; and an attachment mechanism and wherein the first and second opposingly disposed spring-loaded levers provide a user interface for operation of the forked end.

2. The hand held personal tool for use to reseat and repair sod comprising of claim 1, wherein the first opposingly disposed spring-loaded lever comprises a deployment lever and the second opposingly disposed spring-loaded lever comprises a retraction lever.

3. The hand held personal tool for use to reseat and repair sod of claim 1 wherein the forked end springs into deployment position in an automated manner.

4. The hand held personal tool for use to reseat and repair sod of claim 1 wherein the forked end springs into storage position in an automated manner.

5. The hand held personal tool for use to reseat and repair sod of claim 1, wherein the forked end includes two prongs separated by a spacing and projecting away from the handle.

6. The hand held personal tool for use to reseat and repair sod of claim 5, wherein the tool is approximately three inches long in its retracted state.

7. The hand held personal tool for use to reseat and repair sod of claim 1, wherein the forked end is approximately 1½ inches in length.

8. The hand held personal tool for use to reseat and repair sod of claim 1, wherein the concave recession faces upward when the forked end of said tool is inserted into the ground.

9. The hand held personal tool for use to reseat and repair sod of claim 8, wherein the concave recession is approximately ¾ of an inch wide.

10. The hand held personal tool for use to reseat and repair sod of claim 9, further comprising a means for supporting a cigar.

11. The hand held personal tool for use to reseat and repair sod of claim 10, wherein the handle is made from wood inserts, composite materials, and mother of pearl.

12. The hand held personal tool for use to reseat and repair sod of claim 11, wherein said handle is approximately 3 inches long.

13. The hand held personal tool for use to reseat and repair sod of claim 12, wherein the attachment mechanism is located on the side of the handle opposite the side that a switch button and the round ball marker are located.

14. The hand held personal tool for use to reseat and repair sod of claim 13, wherein the attachment mechanism is removable.

15. The hand held personal tool for use to reseat and repair sod of claim 14, wherein the belt clip is made of plastic or metal in an injection molding process requiring the design and use of custom molds.

* * * * *